US006478900B1

(12) United States Patent
Isogawa et al.

(10) Patent No.: US 6,478,900 B1
(45) Date of Patent: Nov. 12, 2002

(54) METHOD OF FORGING PRECIPITATION HARDENING TYPE STAINLESS STEEL

(75) Inventors: Sachihiro Isogawa, Nagoya (JP); Masamichi Kawano, Chita (JP); Katsuyoshi Sakoda, Nagoya (JP)

(73) Assignee: Diado Tokushuko Kabushiki Kaisha, Nagoya (JP)

( * ) Notice: Subject to any disclaimer, the term of this patent is extended or adjusted under 35 U.S.C. 154(b) by 1330 days.

(21) Appl. No.: 08/674,102

(22) Filed: Jul. 1, 1996

Related U.S. Application Data

(63) Continuation-in-part of application No. 08/366,777, filed on Dec. 30, 1994, now abandoned.

(51) Int. Cl.[7] ..... C21D 8/00
(52) U.S. Cl. ..... 148/608; 148/609; 148/649
(58) Field of Search ..... 148/608, 624, 148/649, 609

(56) References Cited

U.S. PATENT DOCUMENTS 3,841,126 A * 10/1974 Minami et al. ..... 72/45
4,608,851 A * 9/1986 Khane ..... 72/364

FOREIGN PATENT DOCUMENTS

JP 4-280918 10/1992
JP 6-010042 1/1994

OTHER PUBLICATIONS

Van Vlack, Elements of Materials Science and Engineering, 3rd edition, Addison–Wesley Publishing Company, Inc 1975 pp 191–194.*
Smith, William F., Structure and Properties of Engineering Alloys, McGraw–Hill Book Company, 1981, pp 305–309.*

* cited by examiner

*Primary Examiner*—Sikyin Ip
(74) *Attorney, Agent, or Firm*—Varndell & Varndell, PLLC

(57) ABSTRACT

An improved method of forging a precipitation hardening type stainless steel. The method comprises the steps of soaking the precipitation hardening type stainless steel at a temperature of austenitizing range, cooling the steel to a temperature in the range of 200–700° C., preferably 400–600° C., and subjecting the steel to forging at the temperature in this range. Conventional lubricants and die cooling oils can be used without being deteriorated due to high temperature. It is preferable to forcibly cool the soaked steel to adjust the temperature of the steel at which it is forged. The forged steel is then age hardened to exhibit inherent hardness.

1 Claim, 8 Drawing Sheets

△ : 25℃

○ : 25℃→1050℃×900s→25℃

▽ : 25℃→1050℃×900s→25℃→500℃×4hr→25℃

× : 25℃→1050℃×900s→500℃×4hr→25℃

● : 25℃→500℃×4hr→25℃

FIG. 9A(a)
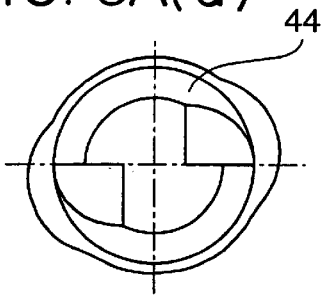
FIG. 9A(b)
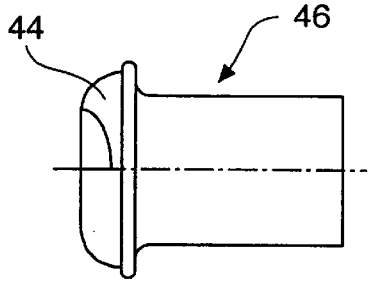
FIG. 9B(c)
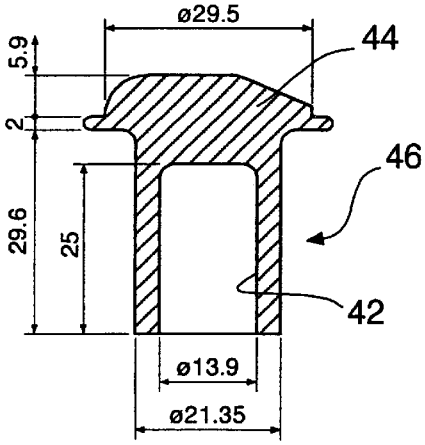
FIG. 9B(b)
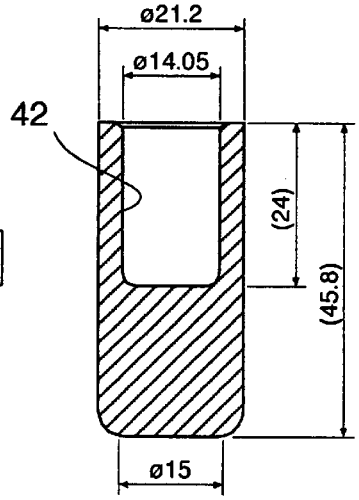
(2)
(1)
FIG.10
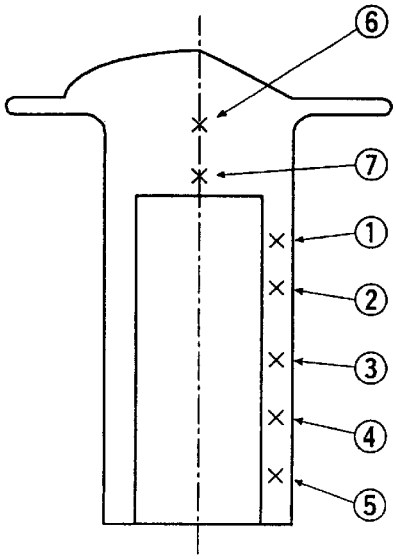
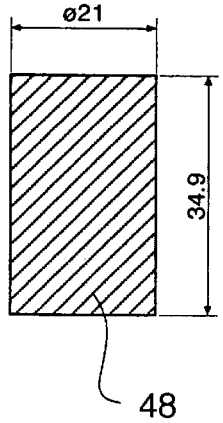
FIG. 9B(a)

METHOD OF FORGING PRECIPITATION HARDENING TYPE STAINLESS STEEL

CROSS-REFERENCE TO RELATED APPLICATION

This application is a continuation-in-part application of U.S. Ser. No. 08/366,777, filed Dec. 30, 1994, now abandoned.

BACKGROUND OF THE INVENTION

The invention concerns a method of forging precipitation hardening type stainless steel.

At forging processing of a steel, if deformation resistance of the steel is high and life of tool is short, the material is usually reheated to a suitable temperature to decrease the deformation resistance, and then subjected to forging.

In case of precipitation hardening type stainless steels such as those having martensitic structure, e.g., SUS630, as is well known, because the martensitic structure is very hard and the deformability thereof is low, it is necessary to heat the material to be processed to a high temperature such as 600° C., so that deformation resistance of the material may be low (i.e., 70 kgf/mm$^2$ or less) and that the tool lives may be long.

Generally, in forging processes, for the purpose of preventing seizure of the work to the tools such as dies it is often practiced to form lubricating film (e.g., graphite coating) on the work or the die, or to spray a cooling oil to coat the dies. However, at a high temperature as 600° C. or higher either the lubricating agent or the cooling oil may deteriorate by being oxidized, and therefore, these countermeasures are not effective.

Thus, it has been the actual fact that the precipitation hardening type steels can only be processed by machining to form the desired shape or by forging at such a low temperature as about 300° C. Forging at this low temperature may not give products of complex shapes or high forging ratios.

SUMMARY OF THE INVENTION

The object of this invention is to solve these problems by providing an improved method of forging precipitation hardening type stainless steels. The method of forging of this invention comprises: soaking a precipitation hardening type stainless steel at a temperature of austenitizing range; cooling the steel to a temperature of 200–700° C.; and forging the steel at this temperature.

After being heated to a temperature of austenitizing range and subsequently cooled to a temperature of 200–700° C., preferably 400–600° C., the structure of the material, which was once austenitized, remains as it is and is not transformed to martensite structure. Thus, the invention makes it possible to process the material in the condition of high ductility and softness of austenite structure. Forging may thus be possible to carry out at such a low temperature as less than 700° C., approximately 200° C. Therefore, the conventional lubricating film forming agents and die cooling oil can be used, and processing of higher forging ratios, which as been considered quite difficult, can be carried out.

BRIEF EXPLANATION OF THE DRAWINGS

FIGS. 9A(*a*), 9A(*b*), 9B(*a*), 9B(*b*), and 9B(*c*) illustrate sequence of steps of forging in the example of FIG. 8 and the shapes of the forged work pieces; FIGS. 9A(*a*) and 9A(*b*) showing a plan view and a side view, and FIGS. 9B(*a*), 9B(*b*), and 9B(*c*) showing longitudinal cross sections;

FIG. 10 illustrates the shape of the product in the example and the locations of determining hardness in the work piece.

DETAILED EXPLANATION OF THE PREFERRED EMBODIMENTS

Figure 2:
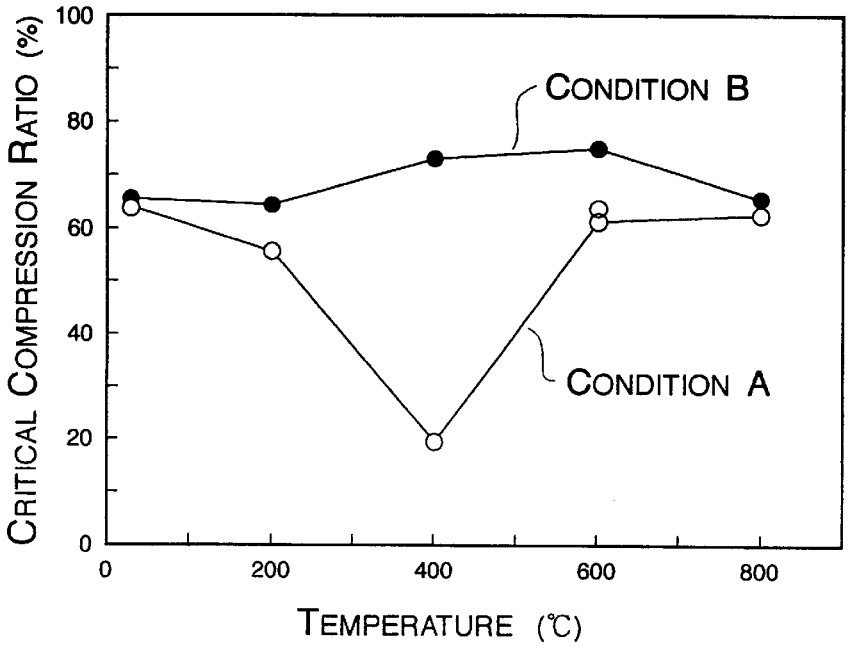
FIG. 2 is a graph showing critical upsetting ratios given by the treatment and processing patterns shown in FIG. 1.

As noted, FIG. 2 mentioned above shows the critical compression ratios of the steel processed in accordance with the present invention with comparison of a steel processed by a conventional technology. In FIG. 2 graph "B" shows the results of the treatment according to one of the examples of this invention, and "A", the results of treatment according to the conventional method. As seen from the results the critical compression ratios of the steel processed by the invention are higher over the whole range of temperature, 200–700° C., than those of the steel process by the conventional technology.

It should be particularly notes that, in the conventional process the critical compression ratio is extremely low at a temperature around 400° C., which temperature has been considered to be the most suitable for processing, while in the present method the critical compression method is high at this temperature. The "critical compression ratio" here is defined as the highest compression ratio measured in the process of compressing a steel until a crack occurs in the steel.

Figure 1:
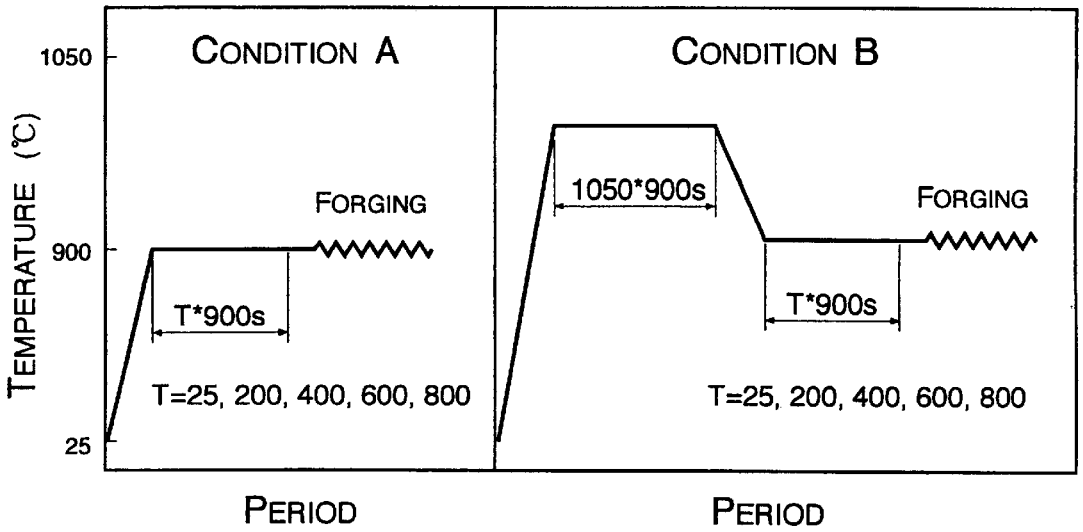
FIG. 1 illustrates treatment and processing patterns of works according to the present invention and to the conventional technology.

Details of the above conditions "A" and "B" are as shown in FIG. 1. Condition A is to heat the steel which is at room temperature to a processing temperature. Under this condition the steel is processed in the state of martensite.

On the other hand, condition B is to heat the steel which is at room temperature to a temperature of austenitizing range, and then to cool the steel to a processing temperature. The steel here is processed in the state of austenite.

Figure 3A:
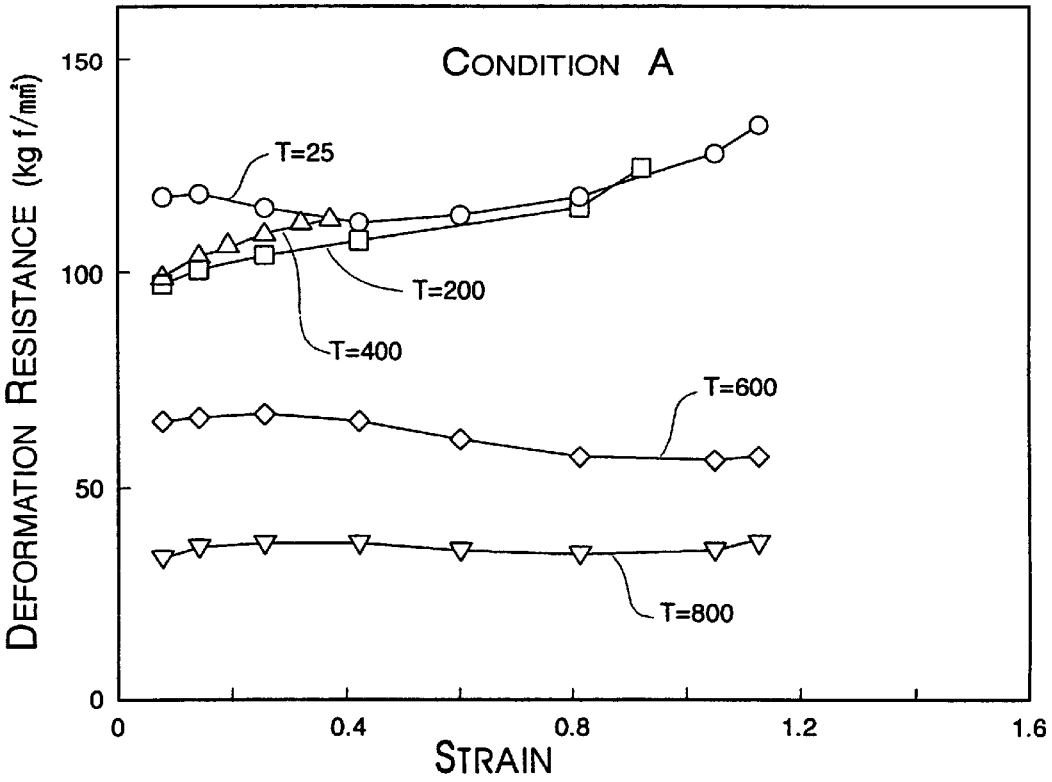
FIGS. 3A and 3B are graphs showing deformations resistance given by the treatment and processing patterns shown in FIG. 1; 3A being under "condition A" and 3B for "condition B"
Figure 3B:
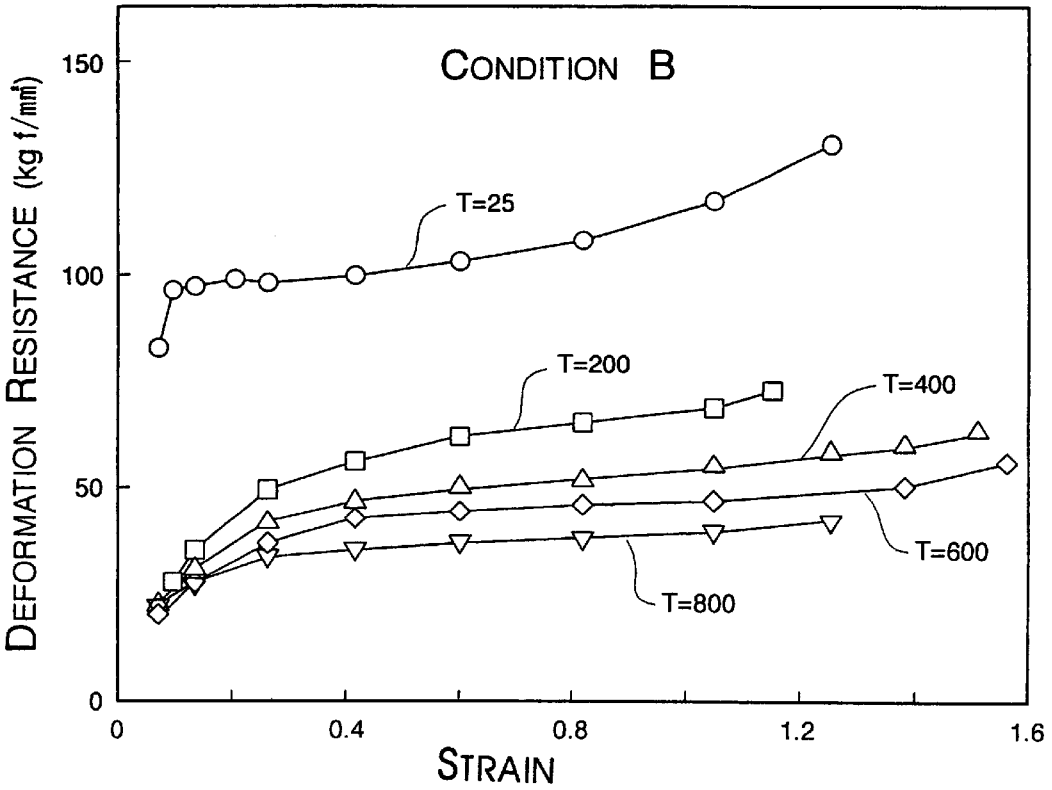

As noted above, FIGS. 3A and 3B show the deformation resistance at the above compression tests. As seen from these graphs, in the conventional technology, desirable deformation resistance or deformability can be obtained at a temperature about 600° C., while in the present method, desirable deformation resistance or deformability can be obtained at such a low temperature as 200° C. This means that the present method enables desirable forging at a low temperature down to 200° C.

The steel processed in accordance with the present invention is subjected to age treatment for precipitation hardening. It has been ascertained that this age hardening assures the same effect as that of conventional processing, i.e., the same hardness as that of processing and age hardening according to the conventional method can be achieved.

Figure 4:
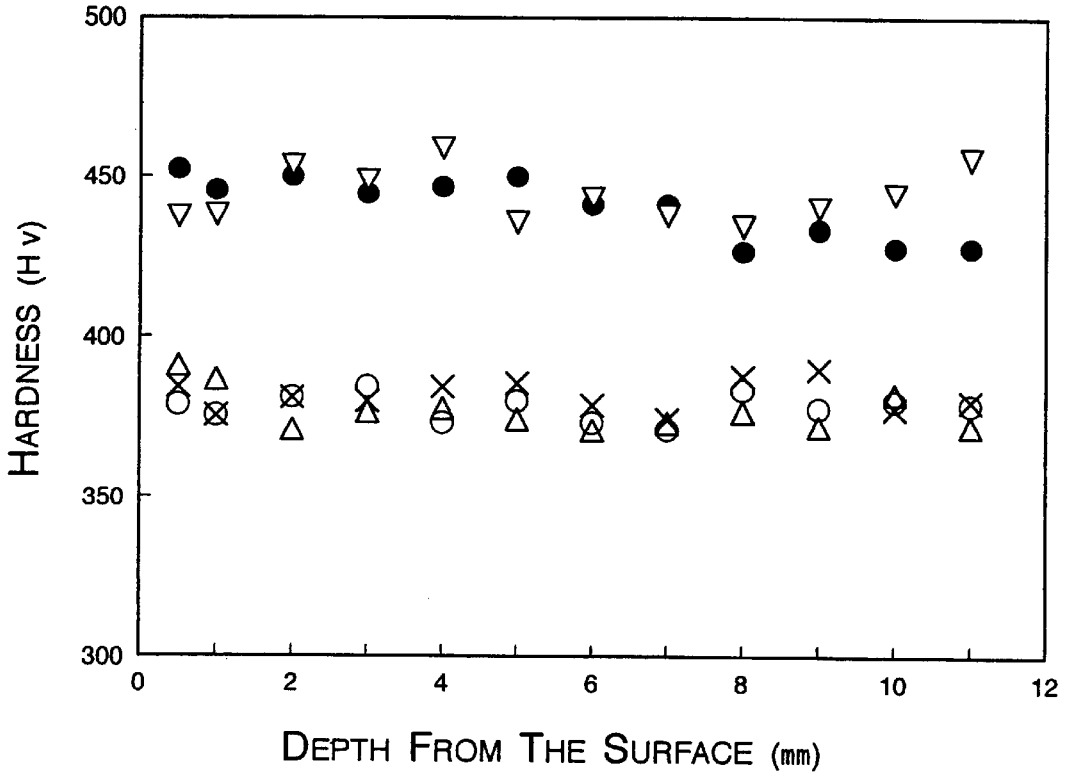
FIG. 4 is a graph showing the hardness given by age hardening subsequent to the treatment and processing of FIG. 1 with comparison of the hardness given by the other treatment and processing.

FIG. 4 illustrates this fact. In the Figure solid spots show the hardness of the cases of age hardening conducted for 4 hours after heating from a room temperature to 500° C., and inverted triangles show the hardness of the cases of heating to the austenitizing range, cooling to a room temperature and forging is carried out in the temperature range of 200–700° C., and then the temperature of the steel is increased again to 500° C. for age hardening over 4 hours. The graph proves that the cases of solid circle and the cases of reverse triangle give substantially the same data.

The plots of cross marks are the data of the case where temperature of the steel was decreased from austenitizing range to 500° C., without cooling to a room temperature, and age hardening was carried out at this temperature. The results show that sufficient age hardening effect cannot be obtained unless the steel which was once austenitized was transformed to martensite.

Just after the step of soaking the precipitation hardening type stainless steel, in the present invention it is preferable to forcibly cool the steel to adjust the temperature of the steel to be processed in the subsequent forging step. This enables putting the cooling rate of the steel from austenite state in accordance with the rate of forging, and thus productivity of forging may be remarkably increased.

Figure 5:
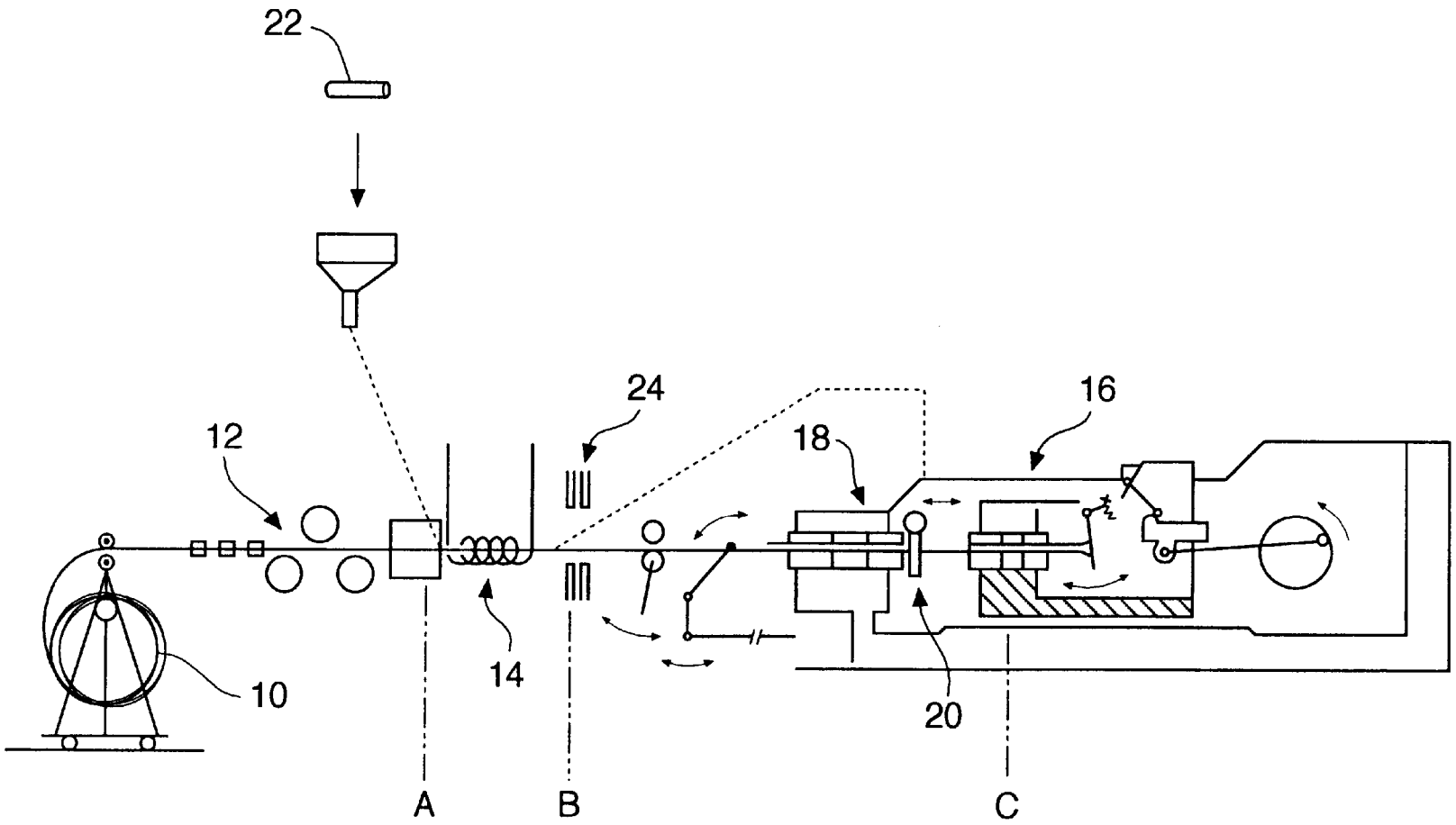
FIG. 5 illustrates steps of processing according to the present invention.

FIG. 5 illustrates application of this invention to a process of forging a rod in the form of a coil or slags previously cut in a certain length. In the Figure reference 10 indicates a rod in the form of a coil; reference 12, a straightening machine comprising pinch rollers to straighten the rod wound off from the coil; reference 14, an induction heating device; reference 16, a forging device. The forging device includes a cutter 13 to cut the rod, and a transferring device 20 to hold and transfer the cut blanks.

Reference 22 indicates a slag which was previously cut to a determined length. The device can use not only rods from a coil but also slag 22 as the blanks.

The device shown in FIG. 5 is equipped with a forced cooling device 24 which blows air from air nozzles at just downstream of the induction heating device 14. The material which was once heated to austenitizing temperature is forcibly cooled here and then transferred to forging device 16.

Figure 6:
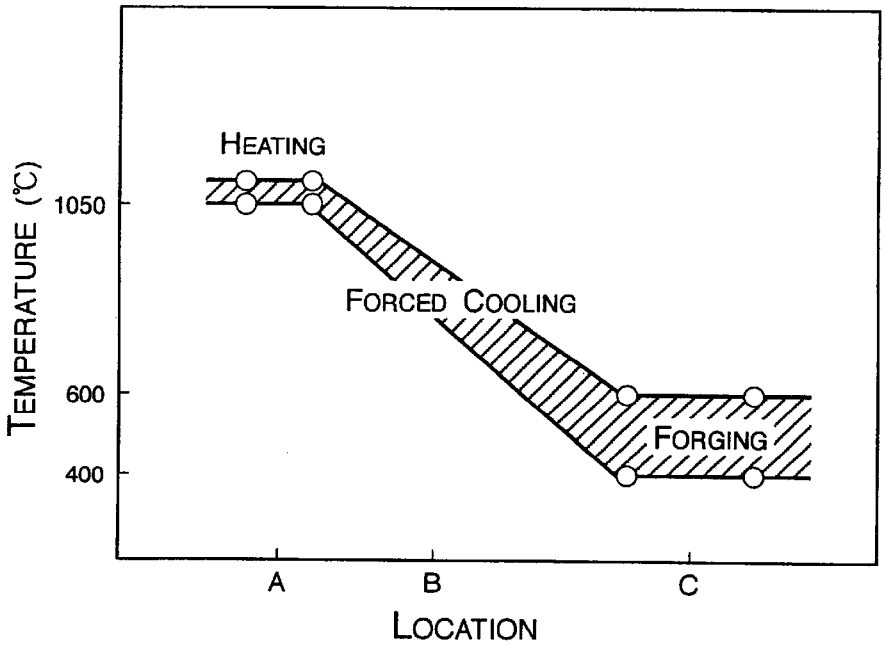
FIG. 6 is a graph showing temperature changes in the steps shown in FIG. 5.

FIG. 6 shows temperature changes in location A, location B and location C along the sequence of the steps of the above described embodiment. The graph shows that the material which is once heated to be austenite is cooled at the forced cooling step to rapidly decrease the temperature and that the temperature of the steel is kept in a suitable range, 400–600° C. In other words, it is shown that, even if forging is carried out at an ordinary speed, temperature of the steel may be decreased to such a low level as 400–600° C.

Figure 7:
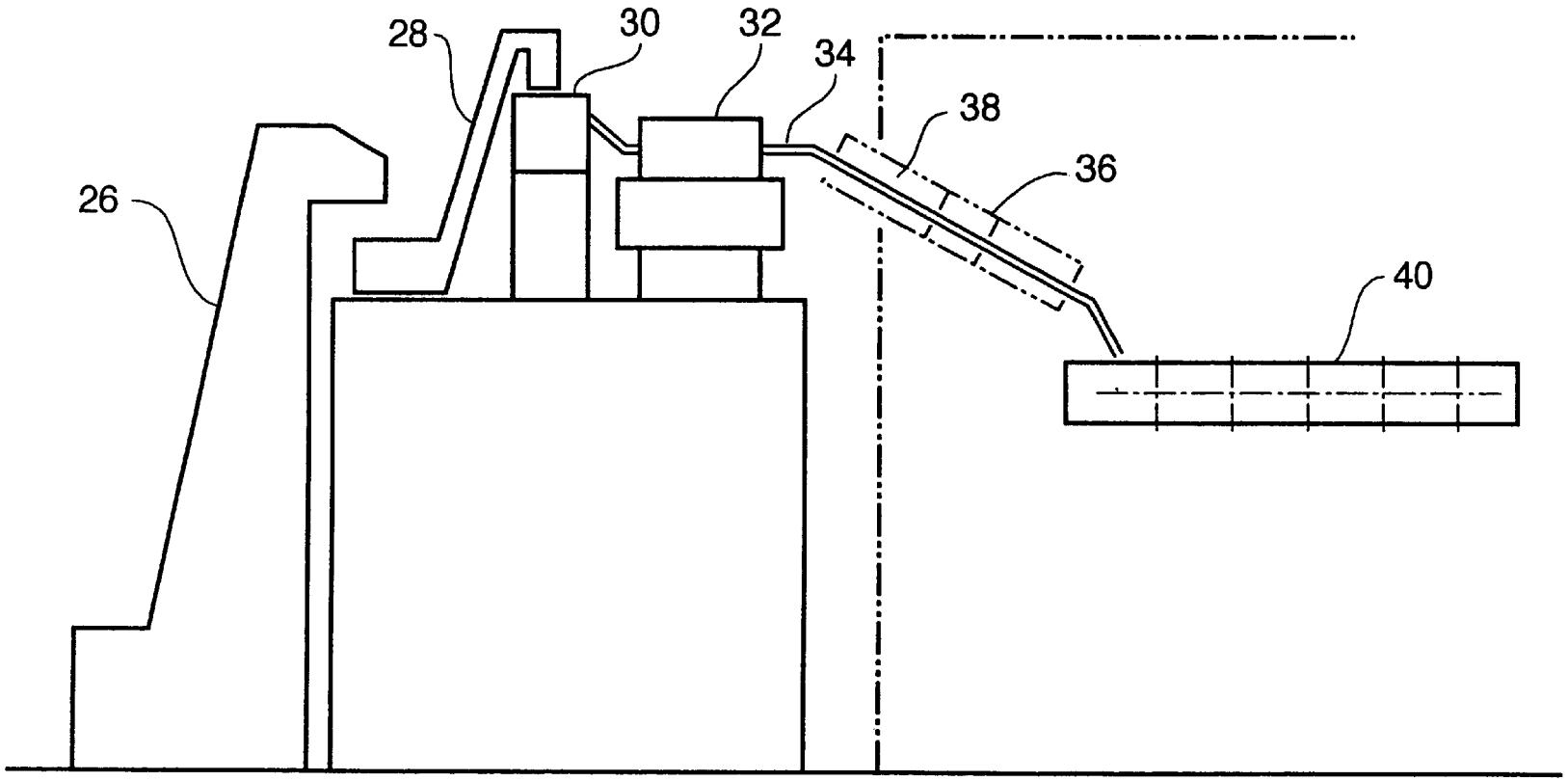
FIG. 7 illustrates steps of processing according to the present invention and other than those in FIG. 5.

FIG. 7 illustrates another embodiment of the present method in which slugs are used as the material to be forged. In the Figure, numerical reference 26 and 28 indicate conveyers; 30, a parts feeder; 32, an induction heating device; 34, a conveyer; 36, lubricant coating step; and 40, dies for forging and shaping the slugs. A forced cooling device 38 is equipped at the upstream of lubricant coating step 36 so as to forcibly cool the material after heating.

As understood from the embodiments above, use of the step of forced cooling enables cooling of the steel in accordance with the speed of the forging step and thereby realizes a forging step of high efficiency.

EXAMPLE 1

Figure 8:
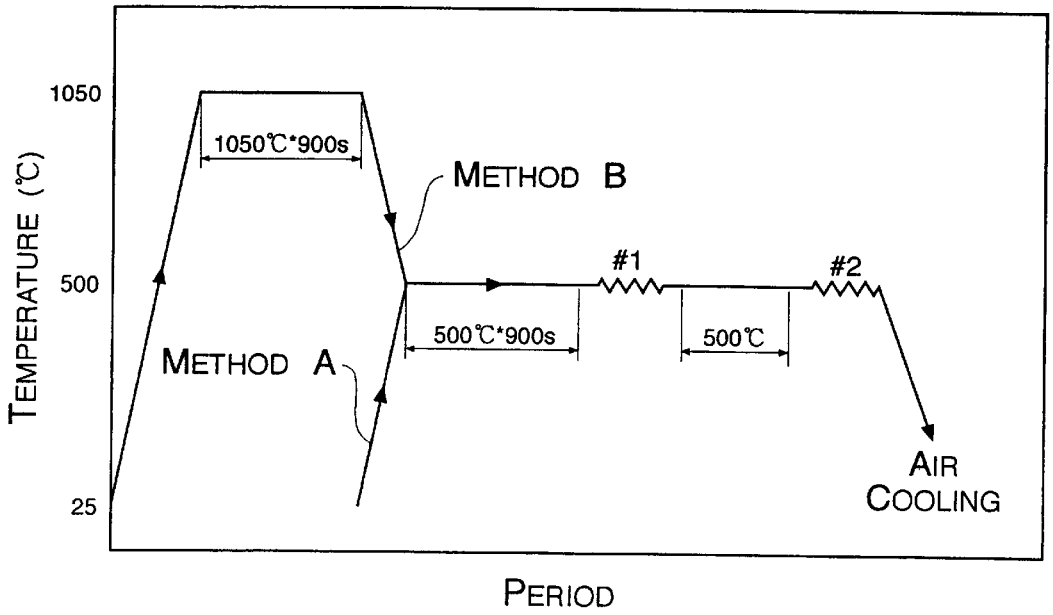
FIG. 8 illustrates methods or conditions of treatment and processing of works used in one example of this invention.

In order to further explain the characteristics of the present invention the following examples are described. Steels of the alloy compositions shown in Table 1 were heat treated by method A or method B and forged as shown in FIG. 8. In FIG. 8 "#1" and "#2" mean the first and the second steps of forging, respectively.

TABLE 1

Chemical Composition of Steels

| | Steel 1 | Steel II | Steel III (wt %, balance Fe) |
|---|---|---|---|
| C | 0.05 | 0.04 | 0.02 |
| Si | 0.31 | 0.42 | 0.20 |
| Mn | 0.64 | 0.66 | 0.20 |
| P | 0.032 | 0.025 | 0.021 |
| S | 0.002 | 0.003 | 0.001 |
| Cu | 3.26 | — | — |
| Ni | 4.20 | 6.80 | 6.5 |
| Cr | 15.63 | 17.20 | 13.0 |
| Mo | 0.24 | — | — |
| Nb | 0.31 | — | — |
| Al | — | 0.90 | 0.85 |
| Ti | — | — | 0.93 |
| | equivalent to SUS630 | equivalent to SUS631 | |

The forging process in this example is to manufacture a product 46 with a hole 42 and a head 44 as shown in FIGS. 9A(*a*), 9A(*b*), 9B(*a*), 9B(*b*), and 9B(*c*). In the first step the blank 48 is subjected to punching to form the hole 42 of depth 24 mm, and then, in the second step processing is made on the side opposite to the hole to form the head 44.

In this forging process determination was made on the hardness of the blanks, lives of punches, shape of the products of the first and the second step, and hardness at various locations of the products after the age hardening treatment, and the data obtained are shown in Table 2, Table 3 and Table 4. In Table 3, the values in the parenthesis of the column "shape" of the products are those of the depth of holes made in the worked pieces, and "crack" means that a crack occurred in the worked pieces.

TABLE 2

Hardness of the Materials

| Steel | Hardness Hv |
|---|---|
| I | 380 |
| II | 390 |
| III | 370 |

TABLE 3

| Steel | Treating Conditions | Process | Forging Tests: Lives of Punches | Lubricating Conditions | Die Material | Shape |
|---|---|---|---|---|---|---|
| I | A | 1 | 580 | $MoS_2$ was | | SKH51 No(15) |
| I | B | 1 | 12500 | sprayed on | SKH51 | Yes |
| II | A | 1 | 320 | the word | SKH51 | No(15) |
| II | B | 1 | 10200 | piece and | SKH51 | Yes |
| III | A | 1 | 720 | the die. | SKH51 | No(15) |
| III | B | 1 | 15500 | | SKH51 | Yes |
| I | A | 2 | — | $MoS_2$ was | SKH51 | No(crack) |
| I | B | 2 | 12500 | sprayed on | SKH51 | Yes |
| II | A | 2 | 320 | the word | SKH51 | No(crack) |
| II | B | 2 | 10200 | piece and | SKH51 | Yes |
| III | A | 2 | 720 | the die. | SKH51 | No(crack) |
| III | B | 1 | 15500 | | SKH51 | Yes |

SKH51 is a high speed steel

The data of hardness in Table 4 shows the hardness at locations 1 to 7 of the products shown in FIG. 10.

TABLE 4

| Location | Hardness of the Product: 1 | 2 | 3 | 4 | 5 | 6 | 7 |
|---|---|---|---|---|---|---|---|
| Hardness (Hv) | 451 | 455 | 458 | 448 | 450 | 455 | 460 |

In view of the results of the example it is concluded that, if forging is carried out in accordance with the present invention, deformability of the material is high and the tool lives are long, and processing to high forging ratios is possible, and that a preferable hardness can be obtained by age hardening treatment after the processing.

EXAMPLE 2

Figure 11:
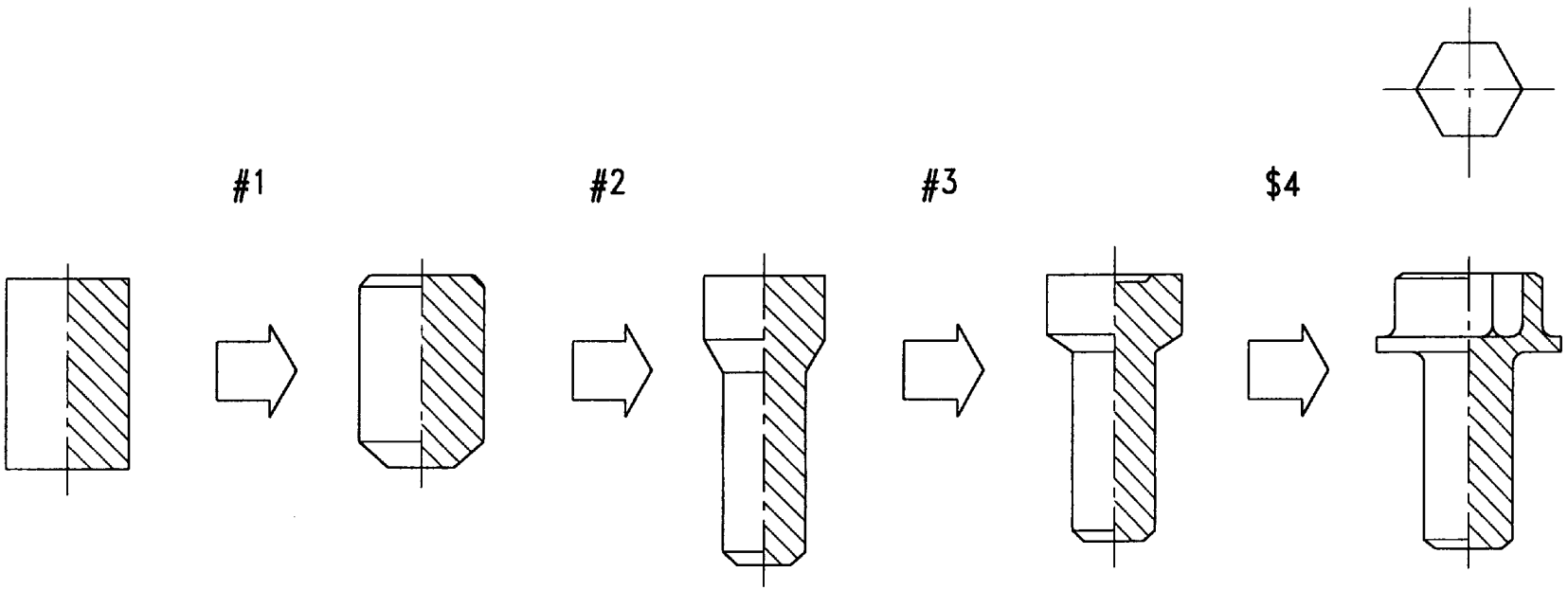
FIG. 11 illustrates changes in the shape of a steel parts from a blank to a product as the processing proceeds in Example 2; the hexagonal shape adjacent the product (rightmost) being the shape of a punch.

Using a typical parts former, automatic forging machine, M8-capt bolts were produced by die forging of precipitation hardening type stainless steel blanks in accordance with the sequence shown in FIG. 11. The blanks were heat treated under "method B" noted above prior to forming, and forged at various temperatures ranging from 200 to 600° C. Tool lives of the second die made of cemented carbide (HRA 83) and the fourth punch made of high speed steel (HRC 63) were recording using the numbers of the parts produced until the tools wore out as the criteria, and the resulting data are shown in Table 5.

TABLE 5

| Run No. | Surface Condition | Temperature ° C. | Second Die | Remarks | Fourth Punch | Remarks |
|---|---|---|---|---|---|---|
| 1 | 1 | 200 | 8,000 | | 3,200 | punch broken |
| 2 | 1 | 450 | 35,000 | | 28,000 | worn away |
| 3 | 1 | 500 | 37,000 | | 31,000 | worn away |
| 4 | 1 | 550 | 35,000 | | 35,000 | worn away |

TABLE 5-continued

| Run No. | Surface Condition | Temperature ° C. | Second Die | Remarks | Fourth Punch | Remarks |
|---|---|---|---|---|---|---|
| 5 | 1 | 600 | 500 | lubricating oil ignited | 500 | broken |
| 6 | 2 | 200 | 12,000 | | 6,000 | broken |
| 7 | 2 | 450 | 36,000 | | 43,000 | worn away |
| 8 | 2 | 500 | 48,000 | | 46,500 | worn away |
| 9 | 2 | 550 | 43,000 | | 53,000 | worn away |
| 10 | 2 | 600 | 5,500 | lubricating oil ignited | 5,500 | |
| 11 | 3 | 200 | 22,000 | | 8,700 | broken |
| 12 | 3 | 450 | 68,000 | | 48,000 | worn away |
| 13 | 3 | 500 | 74,000 | | 54,500 | worn away |
| 14 | 3 | 550 | 70,000 | | 55,000 | worn away |
| 15 | 3 | 600 | 4,800 | lubricating oil ignited | 4,800 | |
| 16 | 4 | 200 | 5,500 | | 3,300 | broken |
| 17 | 4 | 450 | 7,800 | | 5,600 | punch melted down |
| 18 | 4 | 500 | 7,200 | | 6,700 | melted down |
| 19 | 4 | 550 | 6,100 | | 6,600 | melted down |
| 20 | 4 | 600 | 4,000 | thermal crack occurred | 5,500 | melted down |

The "Surface Condition" in Table 5 is as shown below:

| Surface Condition | Coating Film on the Blanks | Lubrication |
|---|---|---|
| 1 | none | oil lubrication |
| 2 | oxalate film | oil lubrication |
| 3 | $MoS_2$ | oil lubrication |
| 4 | $MoS_2$ | none |

As seen from Table 5, lubrication of the tool is necessary for forging with a typical parts former. At a high temperature, however, the lubricating oil will burn. On the other hand, if forging is done at such a low temperature as 200° C., deformation resistance is so high that the wear out.

The above description of the invention is just to show the examples, and the present invertion can be practiced, within the scope of the spirit of the invention, with various conceivable modifications based on the knowledge of those skilled in the art.

We claim:

1. A method of forging a precipitation hardening steel comprising the steps of:

soaking a precipitation hardening stainless steel at a temperature of austenitizing range;

cooling the steel to a temperature in the range of 450° C. to 550° C.; and subjecting the cooled steel to forging at a temperature in the range of 450° C. to 550° C.

* * * * *